US011384725B2

(12) United States Patent
Nio et al.

(10) Patent No.: US 11,384,725 B2
(45) Date of Patent: Jul. 12, 2022

(54) ENGINE DECOMPRESSION DEVICE AND ENGINE

(71) Applicant: HONDA MOTOR CO., LTD., Tokyo (JP)

(72) Inventors: Naotoshi Nio, Saitama (JP); Kota Tokubi, Saitama (JP); Kentaro Sugimura, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/253,399

(22) PCT Filed: Jul. 5, 2018

(86) PCT No.: PCT/JP2018/025600
§ 371 (c)(1),
(2) Date: Dec. 17, 2020

(87) PCT Pub. No.: WO2020/008611
PCT Pub. Date: Jan. 9, 2020

(65) Prior Publication Data

US 2021/0262370 A1 Aug. 26, 2021

(51) Int. Cl.
*F02N 9/00* (2006.01)
*F02N 19/00* (2010.01)
(Continued)

(52) U.S. Cl.
CPC ..... *F02N 19/004* (2013.01); *F01L 1/047* (2013.01); *F01L 13/085* (2013.01); *F01L 1/026* (2013.01);
(Continued)

(58) Field of Classification Search
CPC . F01L 1/026; F01L 1/047; F01L 1/146; F01L 1/181; F01L 1/462; F01L 13/08;
(Continued)

(56) References Cited

U.S. PATENT DOCUMENTS 4,615,313 A 10/1986 Tsumiyama
4,723,516 A 2/1988 Slagley et al.
(Continued)

FOREIGN PATENT DOCUMENTS

CN 1824927 A 8/2006
CN 202659296 U 1/2013
(Continued)

OTHER PUBLICATIONS

May 10, 2021, European Search Report issued for related EP application No. 18925541.7.
(Continued)

*Primary Examiner* — Jorge L Leon, Jr.
(74) *Attorney, Agent, or Firm* — Paratus Law Group, PLLC

(57) ABSTRACT

A decompression shaft (56) of a decompression device (50) includes an engagement pin (53) that is guided by a guide groove (51*a*) formed in a decompression weight (51), a decompression cam (54) that is provided on one cam surface of an intake valve cam (25*c*) and an exhaust valve cam (25*b*) so as to advance and retreat, and a connection portion (55) that connects the engagement pin (53) and the decompression cam (54). The decompression weight (51) is formed with a rotation restricting groove (51*e*) that restricts rotation of the decompression shaft (56) when a force acts in a direction in which the decompression cam (54) moves on the decompression shaft (56) from an advanced position to a retracted position when an engine (E) is stopped and that is continuous with the guide groove (51*a*).

3 Claims, 15 Drawing Sheets

(51) Int. Cl.

| | |
|---|---|
| ***F01L 1/047*** | (2006.01) |
| ***F01L 13/08*** | (2006.01) |
| *F01L 1/02* | (2006.01) |
| *F01L 1/14* | (2006.01) |
| *F01L 1/18* | (2006.01) |
| *F01L 1/46* | (2006.01) |

(52) U.S. Cl.
CPC ..... *F01L 1/146* (2013.01); *F01L 1/181* (2013.01); *F01L 1/462* (2013.01); *F01L 2250/06* (2013.01); *F01L 2760/001* (2013.01); *F01L 2820/035* (2013.01); *F02N 2250/04* (2013.01)

(58) Field of Classification Search
CPC ..... F01L 13/085; F01L 2013/108; F01L 2250/06; F01L 2760/001; F01L 2820/035; F02N 19/004; F02N 2250/04
USPC ..... 123/90.17, 90.31, 90.39, 90.6, 90.61, 123/90.65
See application file for complete search history.

(56) References Cited

U.S. PATENT DOCUMENTS

| | | | | |
|---|---|---|---|---|
| 4,898,133 | A | 2/1990 | Bader | |
| 4,934,348 | A | 6/1990 | Yagi et al. | |
| 4,991,551 | A | 2/1991 | Terai et al. | |
| 6,055,952 | A * | 5/2000 | Gau | F01L 13/08 123/182.1 |
| 6,394,054 | B1 | 5/2002 | Rado et al. | |
| 2005/0279307 | A1* | 12/2005 | Itoh | F01L 13/085 123/90.31 |
| 2006/0048736 | A1* | 3/2006 | Sugiura | F01L 13/085 123/182.1 |
| 2006/0185638 | A1 | 8/2006 | Saito et al. | |
| 2008/0011257 | A1* | 1/2008 | Iwama | F01L 13/085 123/90.31 |
| 2008/0022951 | A1 | 1/2008 | Nomura | |
| 2008/0035089 | A1* | 2/2008 | Yamanishi | F01L 13/085 123/182.1 |
| 2009/0282819 | A1* | 11/2009 | Kashima | F02D 13/0273 60/317 |
| 2009/0301419 | A1* | 12/2009 | Hiraga | F01L 1/047 123/90.31 |
| 2012/0167861 | A1* | 7/2012 | Kashima | F02M 26/01 123/568.11 |
| 2012/0199087 | A1* | 8/2012 | Tsuchiya | F01L 13/08 123/90.39 |
| 2015/0267576 | A1* | 9/2015 | Ninomiya | F01L 13/085 123/182.1 |
| 2016/0160712 | A1* | 6/2016 | Hongo | F01L 13/08 123/182.1 |
| 2017/0276029 | A1* | 9/2017 | Okada | F01L 1/08 |
| 2018/0010487 | A1 | 1/2018 | Tanaka et al. | |

FOREIGN PATENT DOCUMENTS

| | | | |
|---|---|---|---|
| CN | 105317500 | A | 2/2016 |
| CN | 105370339 | A | 3/2016 |
| CN | 107575274 | A | 1/2018 |
| EP | 0167691 | A2 | 1/1986 |
| EP | 1380729 | A1 | 1/2004 |
| EP | 2949888 | A2 | 12/2015 |
| JP | H08-177437 | A | 7/1996 |
| JP | H11-229839 | A | 8/1999 |
| JP | 2016-145537 | A | 8/2016 |
| JP | 2016145537 | A * | 8/2016 |
| TW | 201109518 | A1 | 3/2011 |
| WO | WO 2016/052533 | A1 | 4/2016 |

OTHER PUBLICATIONS

Aug. 28, 2018, International Search Report issued for related PCT Application No. PCT/JP2018/025600.
Aug. 28, 2018, International Search Opinion issued for related PCT Application No. PCT/JP2018/025600.
Nov. 30, 2021, Chinese Office Action issued for related CN Application No. 201880095354.5.

* cited by examiner

-- Prior Art --

-- Prior Art --

ENGINE DECOMPRESSION DEVICE AND ENGINE

CROSS REFERENCE TO PRIOR APPLICATION

This application is a National Stage Patent Application of PCT International Patent Application No. PCT/JP2018/025600 (filed on Jul. 5, 2018) under 35 U.S.C. § 371, which is hereby incorporated by reference in its entirety.

TECHNICAL FIELD

The present invention relates to a decompression device configured to improve startability of an engine and the engine including the decompression device.

BACKGROUND ART

A decompression device is known in which a decompression lift is applied to an intake valve or an exhaust valve to temporarily open the intake valve or the exhaust valve to enable smooth rotation of a crankshaft and improve startability of an engine (for example, see Patent Literature 1). The intake valve or the exhaust valve is in a closed position when the engine is started.

For example, a decompression device 150 according to the related art shown in FIG. 11 includes: a camshaft 125 including an intake valve cam 125*b* and an exhaust valve cam 125*c*; a decompression weight 151 that is rotatably provided via a pivot 125*e* provided on the camshaft 125; a decompression spring 152 configured to bias the decompression weight 151; and a decompression shaft 156 including an engagement pin 153 that is guided by a guide groove 151*a* provided in the decompression weight 151, a decompression cam 154 that is provided on one cam surface of the intake valve cam 125*b* and the exhaust valve cam 125*c* so as to advance and retreat, and a connection portion 155 that connects the engagement pin 153 and the decompression cam 154.

In the decompression device 150 configured in this way, when the engine is started, the decompression cam 154 is located in an advanced position where the decompression cam 154 protrudes from the cam surface, while providing a decompression lift to the intake valve or exhaust valve (hereinafter, appropriately referred to as decompression operation). On the other hand, after the engine has been started, as the decompression weight 151 rotates against a biasing force of the decompression spring 152 due to a centrifugal force, the decompression shaft 156 rotates such that the decompression cam 154 moves to a retracted position where the decompression cam 154 retracts from the cam surface, and the decompression lift for the intake valve or the exhaust valve is released (hereinafter, appropriately referred to as decompression release).

RELATED ART LITERATURE

Patent Literature

Patent Literature 1: JP-A-H08-177437

SUMMARY OF THE INVENTION

Problem that the Invention is to Solve

As shown on an upper side of FIG. 12, in an engine, when the engine is stopped, a piston may not overcome a compression top dead center (a compression TDC), and reverse rotation may occur. In particular, in a working machine (for example, a lawn mower) provided with a clutch having a small inertia, when the engine is stopped, reverse rotation is likely to occur when the engine is stopped.

As shown on a lower side of FIG. 12, if reverse rotation occurs when the engine is stopped, a force acts on the decompression cam 154 from a lifter 127 in a direction of moving the decompression cam 154 from the advanced position to the retracted position, so that the engine may be stopped in a state in which the decompression shaft and the decompression weight 151 are moved to a decompression release side due to this force. In this engine stopped state, the decompression device 150 does not function normally when the engine starts next time, and a starting load (for example, a recoil pulling load) becomes excessive, so there is room for improvement.

The present invention provides an engine decompression device and an engine that are capable of preventing decompression release due to reverse rotation when the engine is stopped.

Means for Solving the Problem

The present invention provides an engine decompression device including:

a camshaft including an intake valve cam and an exhaust valve cam;

a decompression weight that is rotatably provided via a pivot provided on the camshaft;

a decompression spring configured to bias the decompression weight; and a decompression shaft including an engagement pin that is guided by a guide groove formed in the decompression weight, a decompression cam that is provided on one cam surface of the intake valve cam and the exhaust valve cam so as to advance and retreat, and a connection portion that connects the engagement pin and the decompression cam, in which, when the decompression weight rotates against a biasing force of the decompression spring due to a centrifugal force, the decompression shaft rotates such that the decompression cam moves from an advanced position where the decompression cam protrudes from the cam surface to a retracted position where the decompression cam is retracted from the cam surface, and in which the decompression weight is formed with a rotation restricting groove that restricts rotation of the decompression shaft when a force acts in a direction in which the decompression cam moves on the decompression shaft from the advanced position to the retracted position when the engine is stopped and that is continuous with the guide groove.

The present invention provides an engine including:

a valve mechanism configured to operate an intake valve and an exhaust valve in accordance with rotation of a crankshaft; and the decompression device, in which the valve mechanism includes:

a timing gear to be fixed to the crankshaft;

the camshaft that rotates in conjunction with rotation of the timing gear;

a pair of lifters that abut against the intake valve cam and the exhaust valve cam;

a pair of rocker arms in which one end portions of the pair of rocker arms abut against the intake valve or the exhaust valve;

a pair of push rods configured to connect the pair of lifters to the other end portions of the pair of rocker arms; and a pair of valve springs each configured to bias a respective one of the intake valve and the exhaust valve in a closing direction.

Advantages of the Invention

According to the present invention, when a force acts in a direction in which the decompression cam moves on the decompression shaft from the advanced position to the retracted position, the rotation of the decompression shaft is restricted by the rotation restricting groove formed in the decompression weight continuously with the guide groove, so that it is possible to prevent decompression release due to reverse rotation of the engine when the engine is stopped.

MODE FOR CARRYING OUT THE INVENTION

Figure 1:
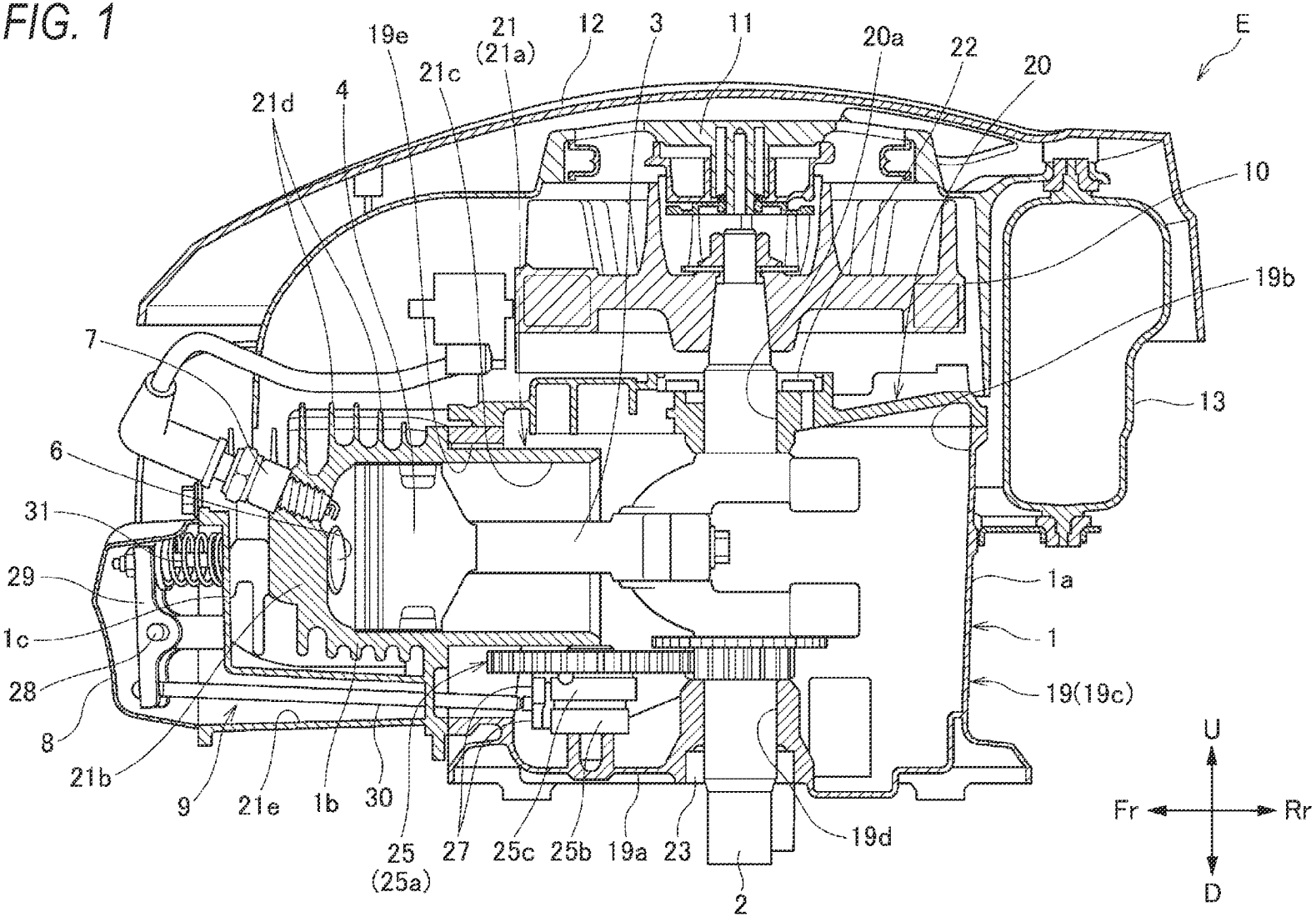
FIG. 1 is a cross sectional view of an engine according to an embodiment of the present invention.

An embodiment of the present invention will be described below with reference to FIGS. 1 to 8. An engine E according to the present embodiment is a small-sized general-purpose engine provided in a walk-behind lawn mower or the like, and is an OHV engine. For simplicity and clarity of description in the present specification, an axial direction of a crankshaft 2 is defined as an upper-lower direction, a direction which is orthogonal to the upper-lower direction and in which a cylinder portion 1*b* extends is defined as a front-rear direction, and a direction orthogonal to the upper-lower direction and the front-rear direction is defined as a left-right direction. In the drawings, a front side of the engine E is indicated as Fr, a rear side of the engine E is indicated as Rr, a left side of the engine E is indicated as L, a right side of the engine E is indicated as R, an upper side of the engine E is indicated as U, and a lower side of the engine E is indicated as D.

Figure 2:
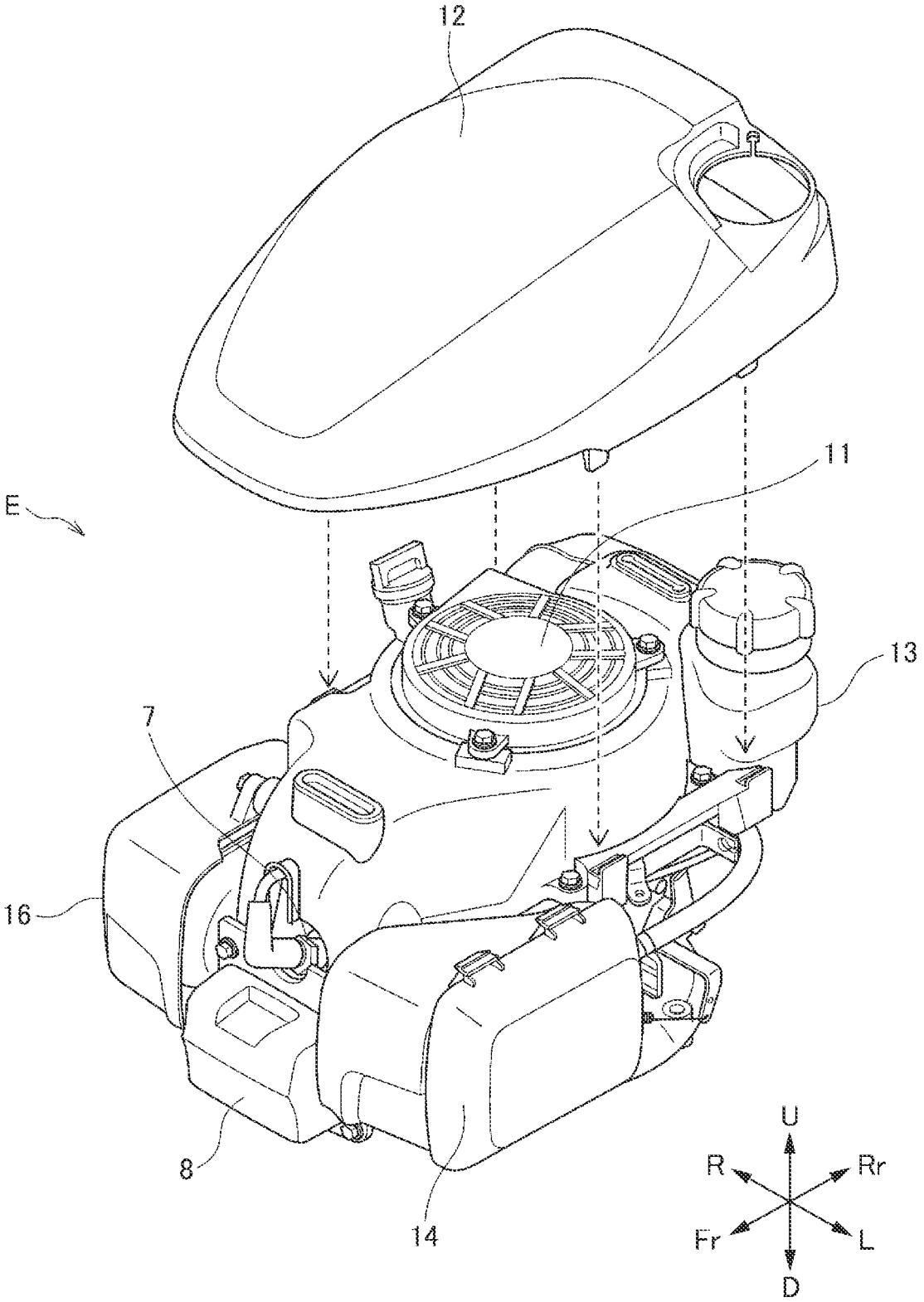
FIG. 2 is a perspective view of the engine whose top cover is removed, as viewed from an obliquely front and upper side.
Figure 3:
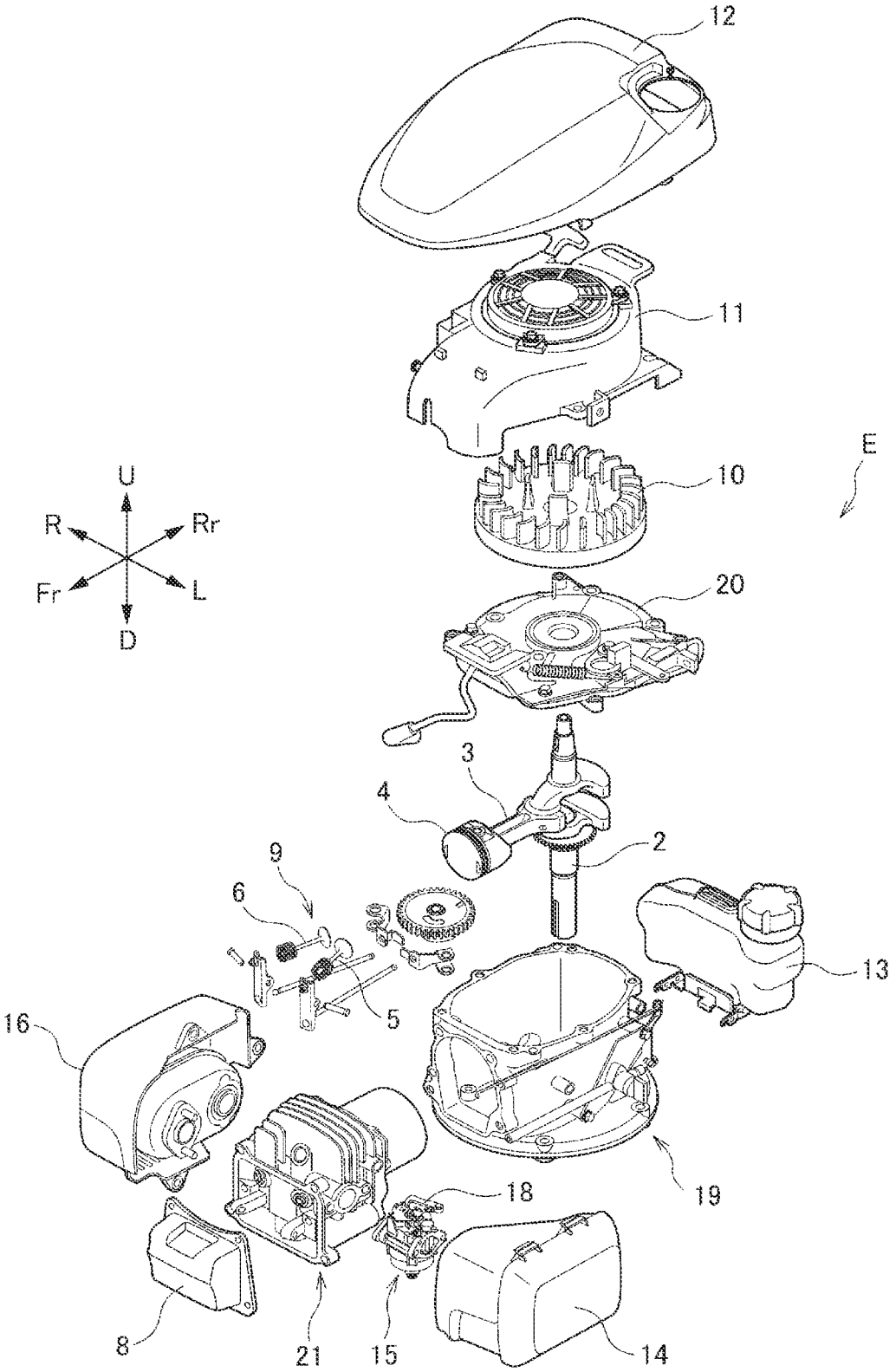
FIG. 3 is an exploded perspective view of the engine as viewed from the obliquely front and upper side.

As shown in FIGS. 1 to 3, the engine E according to the present embodiment includes: an engine body 1 including a crankcase portion 1*a* and the cylinder portion 1*b*; the crankshaft 2 that is rotatably supported by the crankcase portion 1*a* in the upper-lower direction; a piston 4 that is slidably fitted to the cylinder portion 1*b* and is connected to the crankshaft 2 via a connecting rod 3; an intake valve 5, an exhaust valve 6, and a spark plug 7 that are provided on a head portion 1*c* of the cylinder portion 1*b*; a head cover 8 configured to cover the head portion 1*c* of the cylinder portion 1*b*; a valve mechanism 9 configured to operate the intake valve 5 and the exhaust valve 6 in accordance with rotation of the crankshaft 2; a flywheel 10 that is connected to an upper end portion of the crankshaft 2; a recoil starter 11 that is provided above the flywheel 10 and is configured to start the engine E; a top cover 12 configured to cover an upper part of the engine E; a fuel tank 13 configured to store fuel; an air cleaner 14 configured to purify air; a carburetor 15 configured to generate a mixed gas including fuel and air and to supply the mixed gas into the cylinder portion 1*b*; a muffler 16 configured to discharge an exhaust gas discharged from the cylinder portion 1*b* while silencing the discharging; a governor mechanism 17 (see FIGS. 5 and 6) configured to automatically open and close a throttle valve (not shown) of the carburetor 15 in accordance with a rotation speed of the crankshaft 2; and an auto choke mechanism 18 configured to automatically open and close a choke valve (not shown) of the carburetor 15 in accordance with a temperature of the engine body 1.

[Engine Body]

Figure 4:
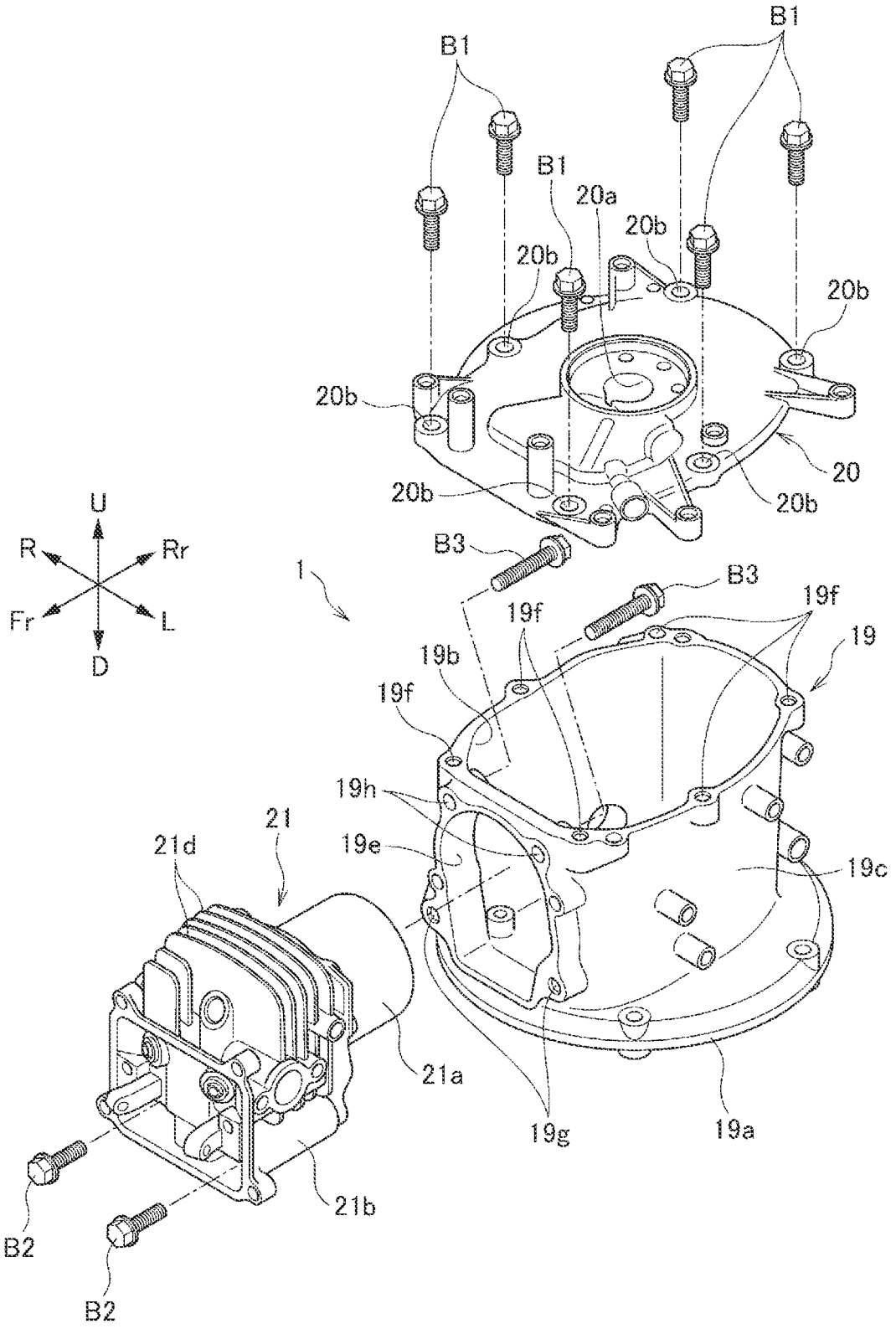
FIG. 4 is an exploded perspective view of an engine body as viewed from the obliquely front and upper side.

As shown in FIG. 4, the engine body 1 includes a crankcase body 19, a crankcase cover 20, and a cylinder unit 21.

Figure 5:
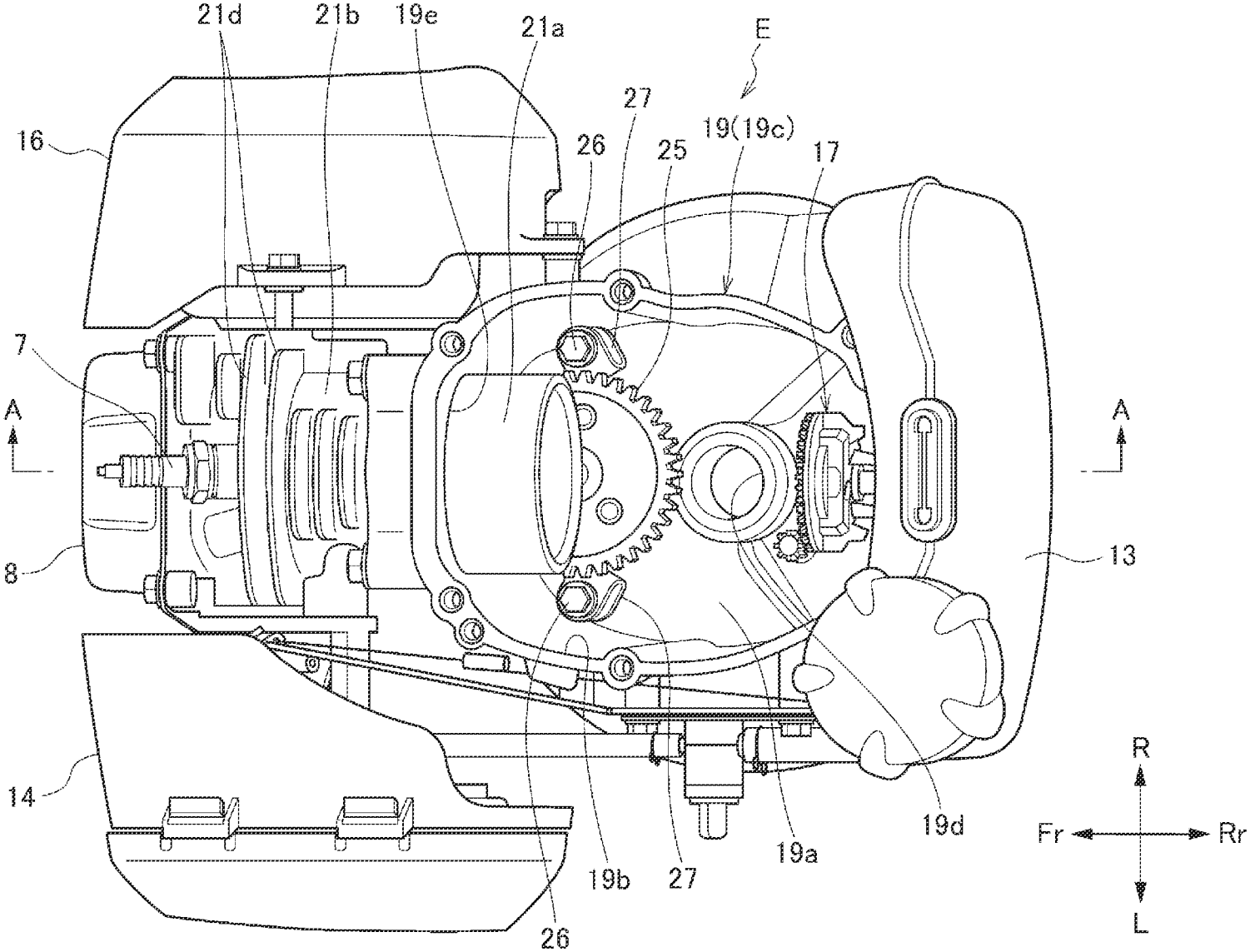
FIG. 5 is a plan view of the engine whose crankcase cover is removed.
Figure 6:
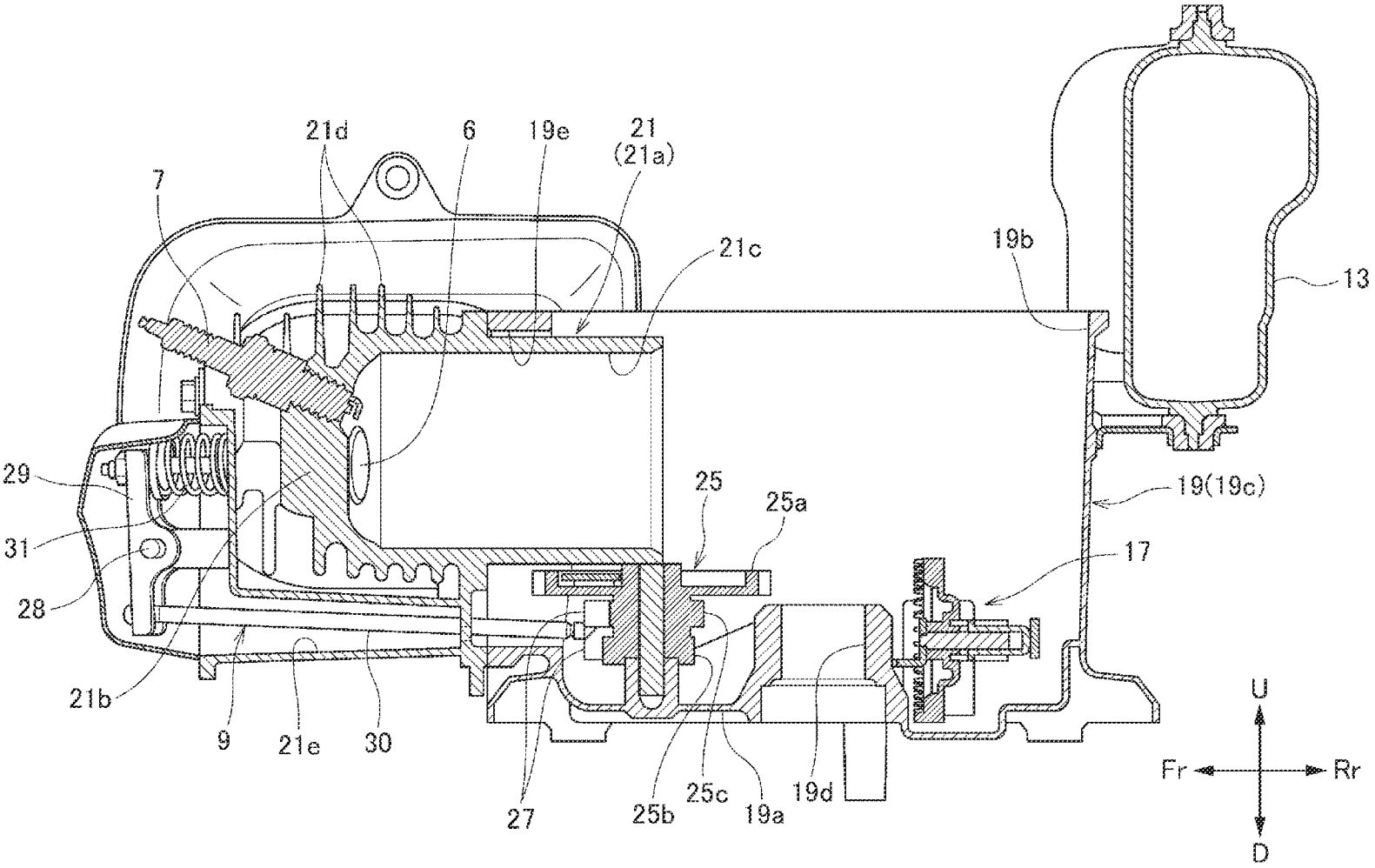
FIG. 6 is a cross sectional view taken along a line A-A in FIG. 5.

As shown in FIGS. 4 to 6, the crankcase body 19 includes a bottom part 19*a*, and a cylindrical portion 19*c* that is formed integrally with the bottom part 19*a* at a lower end portion of the cylindrical portion 19*c* and includes a case opening portion 19*b* at an upper end portion of the cylindrical portion 19*c*. On a center part of the bottom part 19*a*, a first crankshaft through hole 19*d* is formed through which a lower end side of the crankshaft 2 is inserted. On a front surface portion of the cylindrical portion 19*c*, a cylinder insertion hole 19*e* is formed through which a cylinder base portion 21*a* of the cylinder unit 21 is inserted.

As shown in FIG. 4, the crankcase cover 20 is configured to cover the case opening portion 19*b* of the crankcase body 19 and constitutes the crankcase portion 1*a* of the engine body 1 together with the crankcase body 19. On a center part of the crankcase cover 20, a second crankshaft through hole 20*a* is formed through which an upper end side of the crankshaft 2 is inserted. Returning to FIG. 1, the crankshaft 2 is rotatably supported between a second bearing 22 provided adjacent to the second crankshaft through hole 20*a* of the crankcase cover 20 and a first bearing 23 provided adjacent to the first crankshaft through hole 19*d* of the crankcase body 19.

The crankcase cover 20 is detachably attached to an upper end portion of the crankcase body 19 via a plurality of bolts B1. Specifically, a plurality of bolt through holes 20*b* through which the bolts B1 are inserted from above are formed at a peripheral portion of the crankcase cover 20. On the other hand, a plurality of bolt fastening holes 19*f* to which the bolts B1 are fastened from above are formed at the upper end portion of the crankcase body 19. By fastening the bolts B1 to the bolt fastening holes 19*f* via the bolt through holes 20*b*, the crankcase cover 20 can be attached to the crankcase body 19. Conversely, by releasing the fastening of the bolts B1 to the bolt fastening holes 19*f*, the crankcase cover 20 can be removed from the crankcase body 19.

According to the crankcase body 19 and the crankcase cover 20, during maintenance of the engine E, an inside of the crankcase body 19 can be accessed from above by removing the crankcase cover 20. In particular, when the crankshaft 2 is replaced, the crankshaft 2 can be easily replaced by removing the crankcase cover 20 and extracting the crankshaft 2.

As shown in FIGS. 4 to 6, the cylinder unit 21 includes the cylinder base portion 21*a* that is inserted to the cylinder through hole 19*e* of the crankcase body 19 from the front side and is to be positioned inside the crankcase body 19, and a cylinder block 21*b* that extends forward from the cylinder base portion 21*a* and is to be positioned outside the crankcase body 19. The cylinder unit 21 alone constitutes the cylinder portion 1*b* of the engine body 1, and a front end portion of the cylinder block 21*b* constitutes the head portion 1*c*. Inner circumferential surfaces of cylindrical portions of the cylinder base portion 21*a* and the cylinder block 21*b* constitute a cylinder bore 21*c* that is a sliding surface with the piston 4, and a large number of cooling fins 21*d* protrude from an outer peripheral portion of the cylinder block 21*b*.

According to the cylinder unit 21, a plurality of types of cylinder units 21 having different bore diameters are provided, so that it is possible to provide the engine body 1 having different exhaust amounts simply by replacing the cylinder unit 21 while sharing the crankcase body 19 and the crankcase cover 20.

The cylinder unit 21 is detachably attached to the crankcase body 19 via a plurality of bolts B2, B3. For example, a plurality of bolt through holes (not shown) through which the bolts B2 are inserted from the front side are formed at a rear end portion of the cylinder block 21*b*. On the other hand, a plurality of bolt fastening holes 19*g* to which the bolts B2 are fastened from the front side are formed at a front end portion of the crankcase body 19. By fastening bolts B2 to the bolt fastening holes 19*g* via the bolt through holes of the cylinder block 21*b*, the cylinder unit 21 can be attached to the crankcase body 19. Conversely, by releasing the fastening of the bolts B2 to the bolt fastening holes 19*g*, the cylinder unit 21 can be removed from the crankcase body 19.

However, in the engine body 1 according to the present embodiment, when the cylinder unit 21 is detachably attached to the crankcase body 19 via the plurality of bolts B2, B3, the bolts B3 on an upper end portion side are fastened to the cylinder unit 21 from the inside of the crankcase body 19. Specifically, a plurality of bolt through holes 19*h* through which the bolts B3 are inserted frontward from the inside of the crankcase body 19 are formed at the front end portion of the crankcase body 19. On the other hand, a plurality of bolt fastening holes (not shown) to which the bolts B3 are fastened from the rear side are formed at the rear end portion of the cylinder block 21*b*. The bolts B3 are fastened to the bolt fastening holes of the cylinder block 21*b* via, the bolt through holes 19*h* of the crankcase body 19.

According to this attachment structure of the cylinder unit 21, it is not required to form a space for fastening the bolts B3 from the front side on at least the upper end portion side of the cylinder block 21*b*. Therefore, the cylinder unit 21 can be attached to the crankcase body 19 without interfering with an external structure (for example, the cooling fins 21*d*) of the cylinder block 21*b*, and a cooling performance and the like of the engine E can be improved.

[Valve Mechanism]

Figure 7:
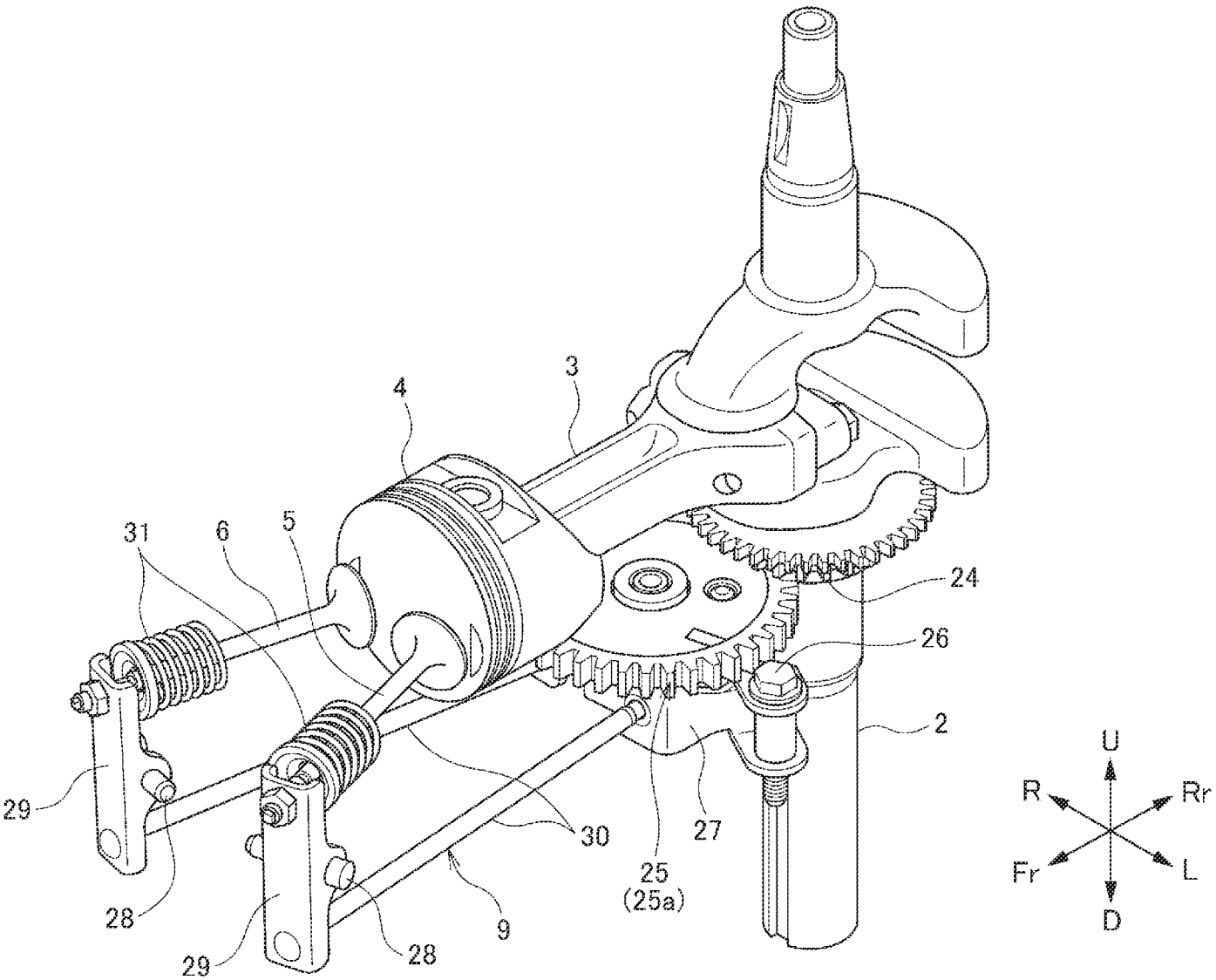
FIG. 7 is a perspective view of a valve mechanism of the engine as viewed from the obliquely front and upper side.
Figure 8:
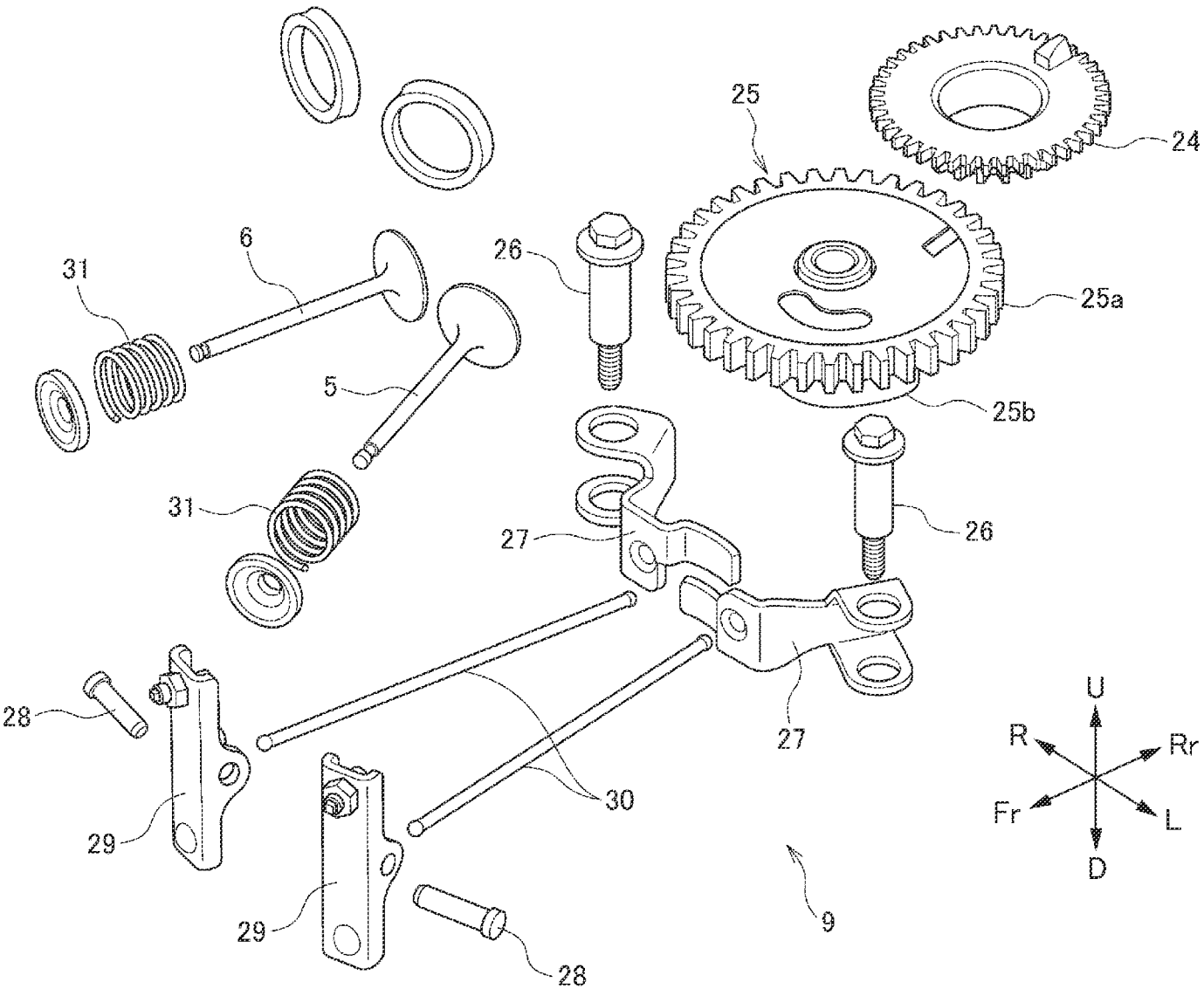
FIG. 8 is an exploded perspective view of the valve mechanism of the engine as viewed from the obliquely front and upper side.
Figure 9:
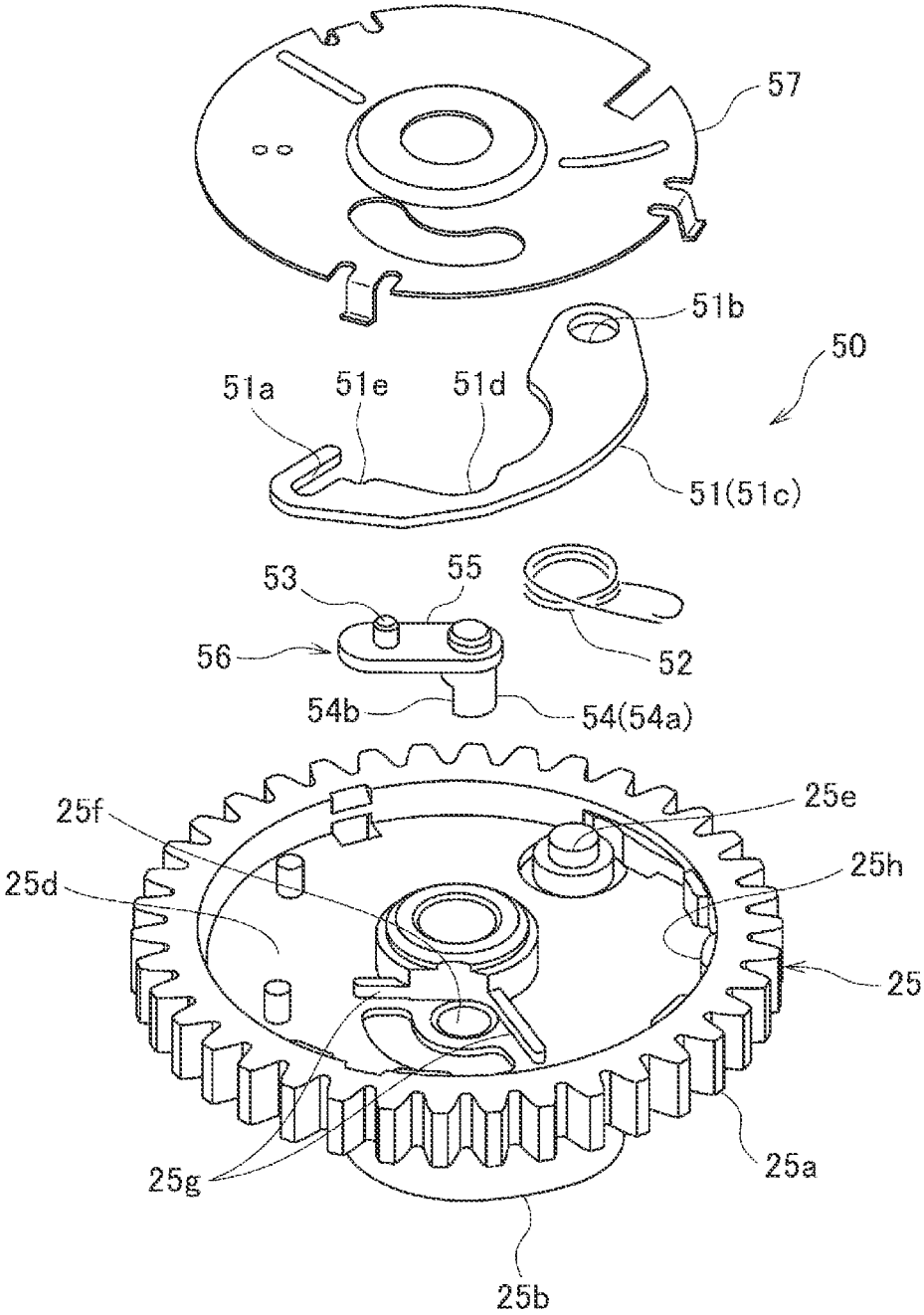
FIG. 9 is an exploded perspective view of an engine decompression device.

As shown in FIGS. 6 to 8, the valve mechanism 9 includes: a timing gear 24 to be assembled to the crankshaft 2 in an integrally rotatable manner; a camshaft 25 rotatably supported on the bottom portion 19*a* of crankcase body 19; a pair of lifters 27 that are swingably supported on the bottom part 19*a* of the crankcase body 19 via stepped bolts 26; a pair of rocker arms 29 which are swingably supported on the front end portion of the cylinder block 21*b* via rocker arm shafts 28, and one end portions of which abut against a front end portion of the intake valve 5 or the exhaust valve 6; a pair of push rods 30 that are accommodated in a push rod accommodation portion 21*e* formed on a lower part of the cylinder unit 21, and connect each of the lifters 27 to a respective one of the other end portions of the pair of rocker arms 29; and a pair of valve springs 31 each configured to bias a respective one of the intake valve 5 and the exhaust valve 6 in a closing direction.

The camshaft 25 includes a gear portion 25*a* that meshes with the timing gear 24 and are driven to rotate at a speed reduction ratio of ½ by the timing gear 24, and a pair of cam portions 25*b*, 25*c* that press the pair of lifters 27 alternately in accordance with the rotation drive of the gear portion 25*a*. When the cam portions 25*b*, 25*c* press the lifter 27, the other end portion of the corresponding rocker arm 29 is pressed via the push rod 30, and the intake valve 5 or the exhaust valve 6 connected to the one end portion of the rocker arm 29 is opened. On the other hand, when the pressing of the lifter 27 by the cam portion 25*b* is released, the intake valve 5 or the exhaust valve 6 is closed due to the biasing force of the valve spring 31. In the present embodiment, the cam portion 25*b* functions as an intake valve cam configured to open and close the intake valve 5, and the cam portion 25*c* functions as an exhaust valve cam configured to open and close the exhaust valve 6.

The camshaft 25 according to the present embodiment is provided below the cylinder base portion 21*a* of the cylinder unit 21. When the camshaft 25 is provided in this way, the inside of the crankcase body 19 can be accessed from above only by removing the crankcase cover 20 even without removing the camshaft 25 during the maintenance of the engine E.

[Configuration of Decompression Device]

Next, a decompression device 50 provided in the camshaft 25 will be described with reference to FIGS. 9 and 10A to 10D.

The camshaft 25 is formed with a circular recess 25*d* on an upper surface of the camshaft 25, and the decompression device 50 is provided in the recess 25*d*. The decompression device 50 according to the present embodiment includes: a decompression weight 51 that is rotatably provided via a pivot 25*e* provided on the camshaft 25; a decompression spring 52 configured to bias the decompression weight 51; a decompression shaft 56 including an engagement pin 53 that is guided by a guide groove 51*a* provided in the decompression weight 51, a decompression cam 54 that is provided on a cam surface of the cam portion 25*b* and the cam portion 25*c* so as to advance and retreat, and a connection portion 55 that connects the engagement pin 53 and the decompression cam 54; and a hold plate 57 configured to cover the recess 25*d* while holding the decompression weight 51, the decompression spring 52, and the decompression shaft 56.

In the decompression device 50 configured in this way, when the engine E is started, the decompression cam 54 is located in an advanced position where the decompression cam 54 protrudes from the cam surface of the cam portion 25*b* or the cam portion 25*c*, while providing a decompression lift to the intake valve 5 or the exhaust valve 6. On the other hand, after the engine E has been started, as the decompression weight 51 rotates against a biasing force of the decompression spring 52 due to a centrifugal force, the decompression shaft 56 rotates such that the decompression cam 54 moves to a retracted position where the decompression cam 54 retracts from the cam surface of the cam portion 25*b* or the cam portion 25*c*, and the decompression lift for the intake valve or the exhaust valve is released. Hereinafter, the recess 25*d* of the camshaft 25, the decompression weight 51, the decompression spring 52, and the decompression shaft 56 will be described in detail.

The recess 25*d* of the camshaft 25 includes, in addition to the above-described pivot 25*e*, a decompression shaft support hole 25*f* that rotatably supports the decompression shaft 56 and exposes the decompression cam 54 to the cam surface of the cam portion 25*b* or the cam portion 25*c* so that the decompression cam 54 can advance and retreat, a convex portion 25*g* that defines a rotation range of the decompression shaft 56 (the connection portion 55), and an inner peripheral wall portion 25*h* that defines a rotation limit position of the decompression weight 51 in a decompression release direction.

The decompression weight 51 is a metal plate member having an arcuate shape along the inner peripheral wall portion 25*h* of the camshaft 25, and includes a fitting hole 51*b* that rotatably fits to the pivot 25*e* of the camshaft 25, an outer peripheral portion 51*c* that abuts against the inner peripheral wall portion 25*h* of the camshaft 25 when the decompression is released, an inner peripheral portion 51*d* opposite the outer peripheral portion 51*c*, a guide groove 51*a* that engages with the engagement pin 53 of the decompression shaft 56, and a rotation restricting groove 51*e* that is continuous with the guide groove 51*a* and is provided at a connection portion between the guide groove 51*a* and the inner peripheral portion 51*d*.

The decompression spring 52 is a torsion coil spring and is provided on the pivot 25*e* of the camshaft 25. The decompression spring 52 biases the decompression weight 51 toward the inner peripheral side by engaging the camshaft 25 on one end side of the decompression spring 52 and engaging the decompression weight 51 on the other end side of the decompression spring 52.

The decompression weight 51 configured in this way is rotatable between a rotation position (hereinafter, appropriately referred to as a decompression operation position) where the rotation restricting groove 51*e* abuts against the engagement pin 53 and a rotation position (hereinafter, appropriately referred to as a decompression release position) where the outer peripheral portion 51*c* abuts against the inner peripheral wall portion 25*h* of the camshaft 25. When the engine E is started, the decompression weight 51 is maintained at the decompression operation position due to a biasing force of the decompression spring 52. On the other hand, after the engine E has been started, the decompression weight 51 is rotated to the decompression release position against the biasing force of the decompression spring 52 due to a centrifugal force.

The guide groove 51*a* is provided on a distal end side away from a rotation fulcrum point (the pivot 25*e*) of the decompression weight 51, and engages with the engagement pin 53 of the decompression shaft 56 to interlock the decompression shaft 56 with the rotation of the decompression weight 51. More specifically, when the decompression weight 51 is located at the decompression operation position, the guide groove 51*a* rotates the decompression shaft 56 to a rotation position where the decompression cam 54 protrudes from the cam surface of the cam portion 25*b* or the cam portion 25*c*. On the other hand, when the decompression weight 51 is located at the decompression release position, the guide groove 51*a* rotates the decompression shaft 56 to a rotation position where the decompression cam 54 is retracted from the cam surface of the cam portion 25*b* or the cam portion 25*c*.

The rotation restricting groove 51*e* restricts rotation of the decompression shaft 56 when a force in a direction in which the decompression cam 54 moves from the advanced position to the retracted position acts on the decompression cam 54 from the lifter 27 (when the engine E is reversely rotated as described later). Specifically, the rotation restricting groove 51*e* includes a restricting surface 51*f* orthogonal to a virtual line L (see FIG. 10D) connecting the pivot 25*e* and the engagement pin 53 when the decompression cam 54 is in the advanced position. When a force in a direction in which the decompression cam 54 moves from the advanced position to the retracted position acts on the decompression cam 54 from the lifter 27, the engagement pin 53 abuts against the restricting surface 51*f*. At this time, since a vector for rotating the decompression weight 51 does not act on the decompression weight 51, the rotation of the decompression shaft 56 is restricted.

As described above, the decompression shaft 56 rotates between the decompression operation position and the decompression release position in conjunction with the rotation of the decompression weight 51. The decompression cam 54 provided on the decompression shaft 56 includes a circumferential surface 54*a* and a flat surface 54*b* obtained by cutting out a part of the circumferential surface 54*a*. When the decompression shaft 56 is located at the decompression operation position, the circumferential surface 54*a* of the decompression cam 54 is protruded from the cam surface of the cam portion 25*b* or the cam portion 25*c*. On the other hand, when the decompression shaft 56 is located at the decompression release position, the decompression cam 54 is retracted on the cam surface of the cam portion 25*b* or the cam portion 25*c* by aligning the flat surface 54*b* of the decompression cam 54 with the cam surface of the cam portion 25*b* or the cam portion 25*c*.

[Operation of Decompression Device]

Next, operation of the decompression device 50 accompanying the start and stop of the engine E will be described with reference to FIGS. 10A to 10D. In FIGS. 10A to 10D, the cam portions 25*b*, 25*c* are indicated by solid lines. However, the cam portions 25*b*, 25*c* are located on an opposite side of the recess 25*d*.

Figure 10A:
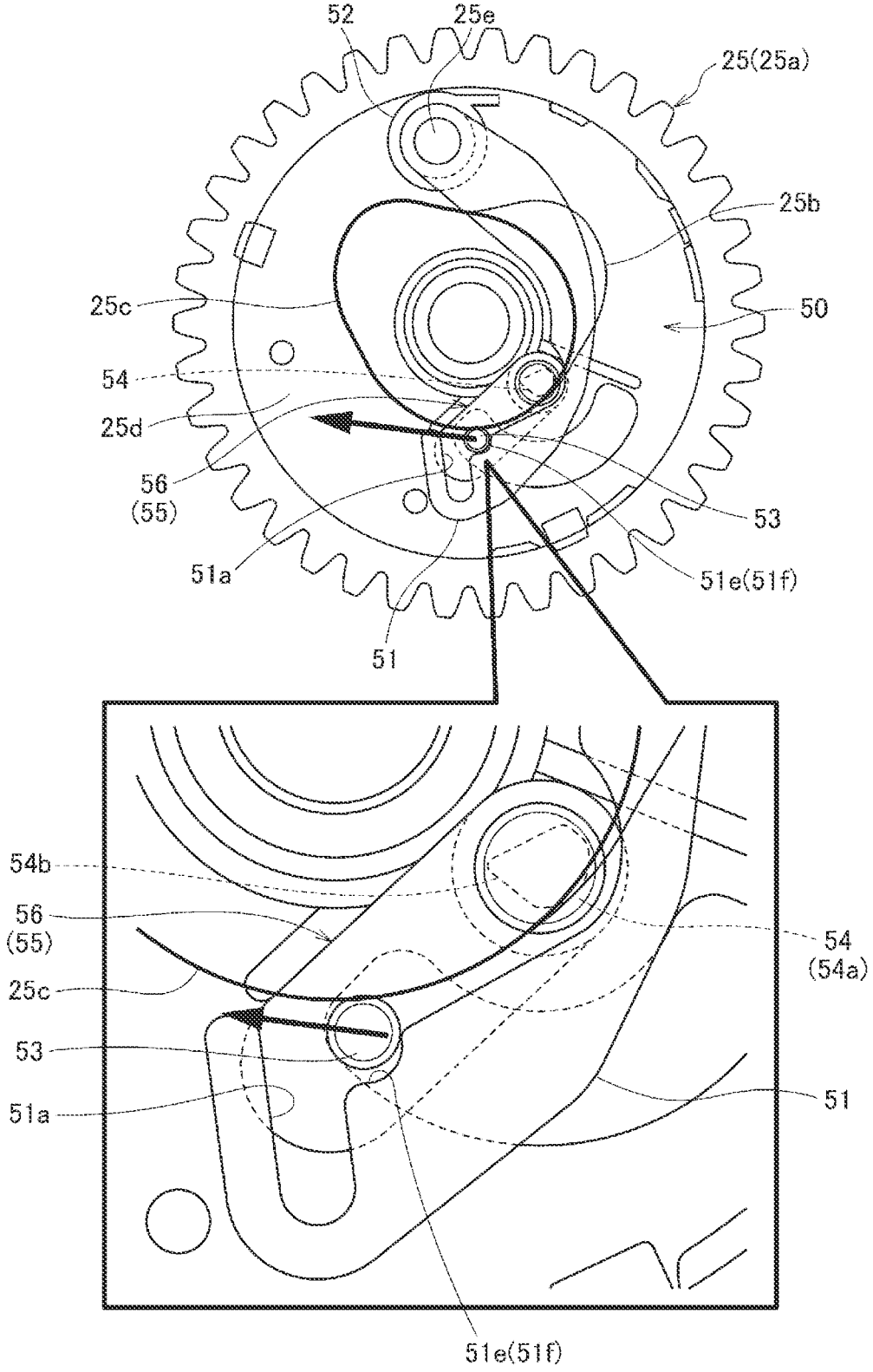
FIG. 10A is an explanatory view showing the decompression device (a decompression operation state) when the engine is started.

As shown in FIG. 10A, when the engine E is started (before starting), the decompression weight 51 is located at the decompression operation position due to a biasing force of the decompression spring 52. At this time, the engagement pin 53 of the decompression shall 56 is located in the rotation restricting groove 51*e* of the decompression weight 51 and is pushed by the decompression weight 51 in a direction of an arrow in FIG. 10A, thereby holding the decompression shaft 56 in the decompression operation position. Therefore, when the engine E is started, the decompression cam 54 provided on the decompression shaft 56 is located in the advanced position where the decompression cam 54 protrudes from the cam surface of the cam portion 25*b* or the cam portion 25*c*, and provides a decompression lift to the intake valve 5 or the exhaust valve 6, thereby improving startability of the engine E.

Figure 10B:
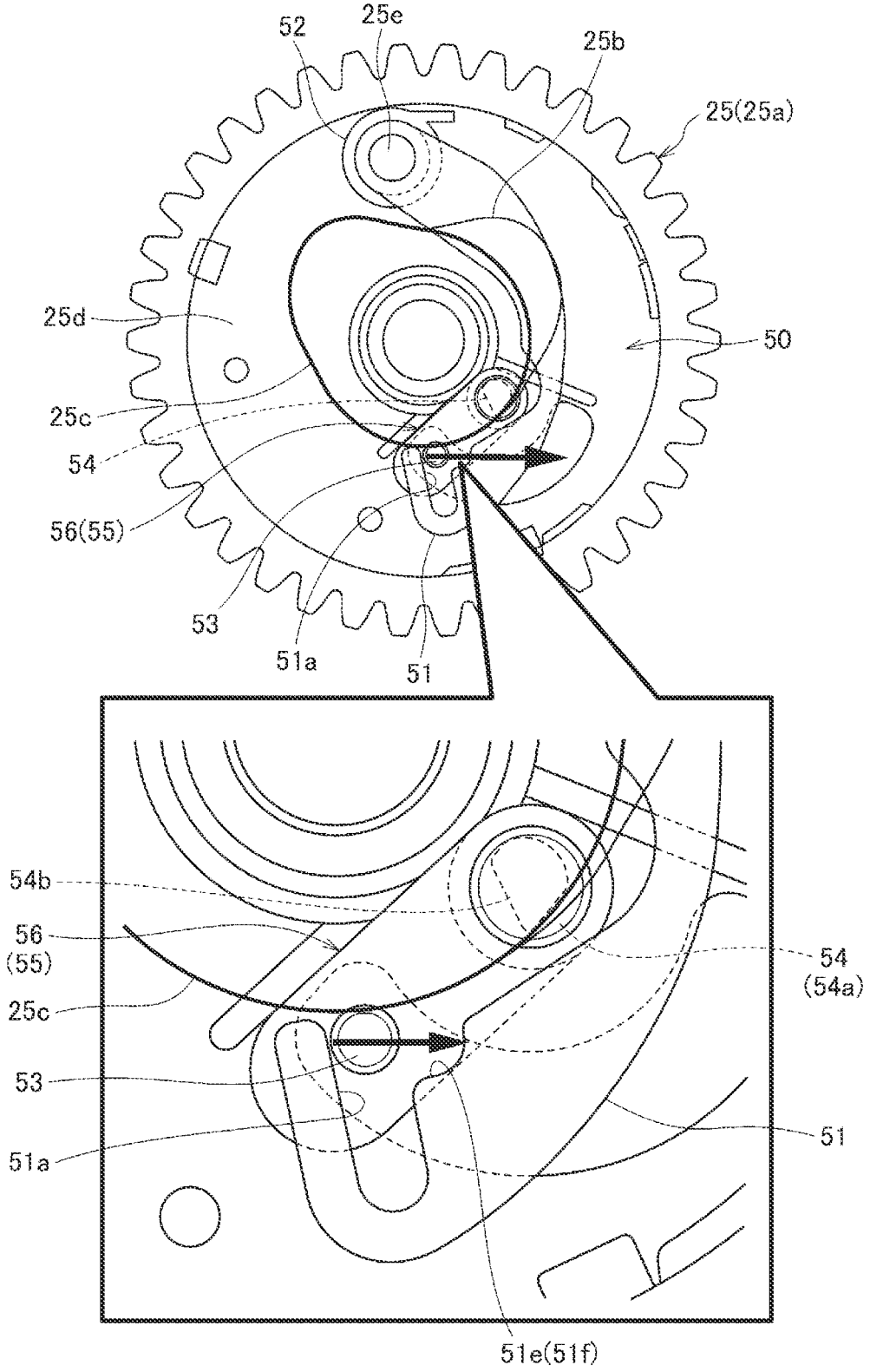
FIG. 10B is an explanatory view showing the decompression device (the decompression operation state→a decompression release state) immediately after the engine has been started.
Figure 10C:
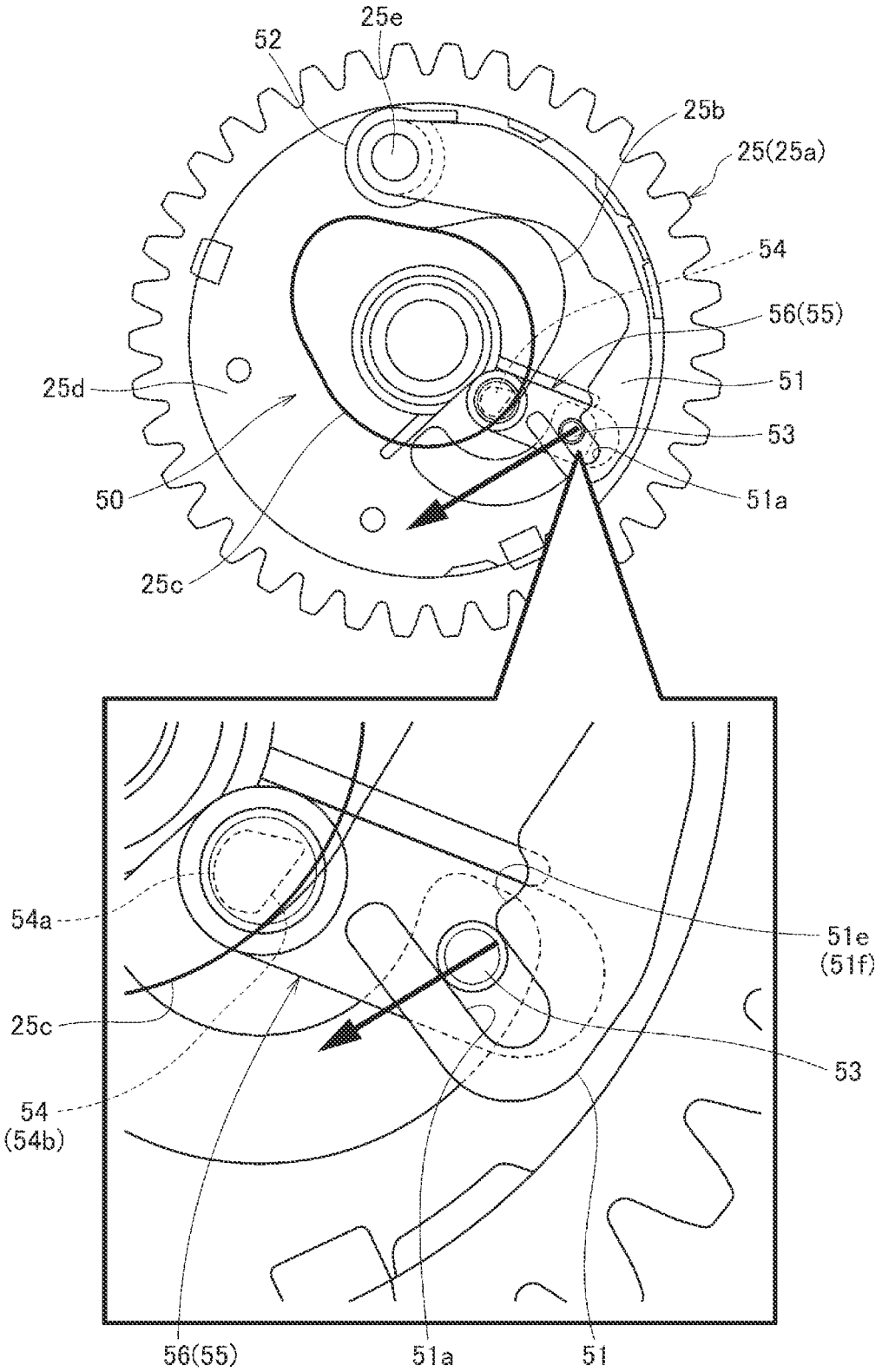
FIG. 10C is an explanatory view showing the decompression device (the decompression release state) after the engine has been started.
Figure 10D:
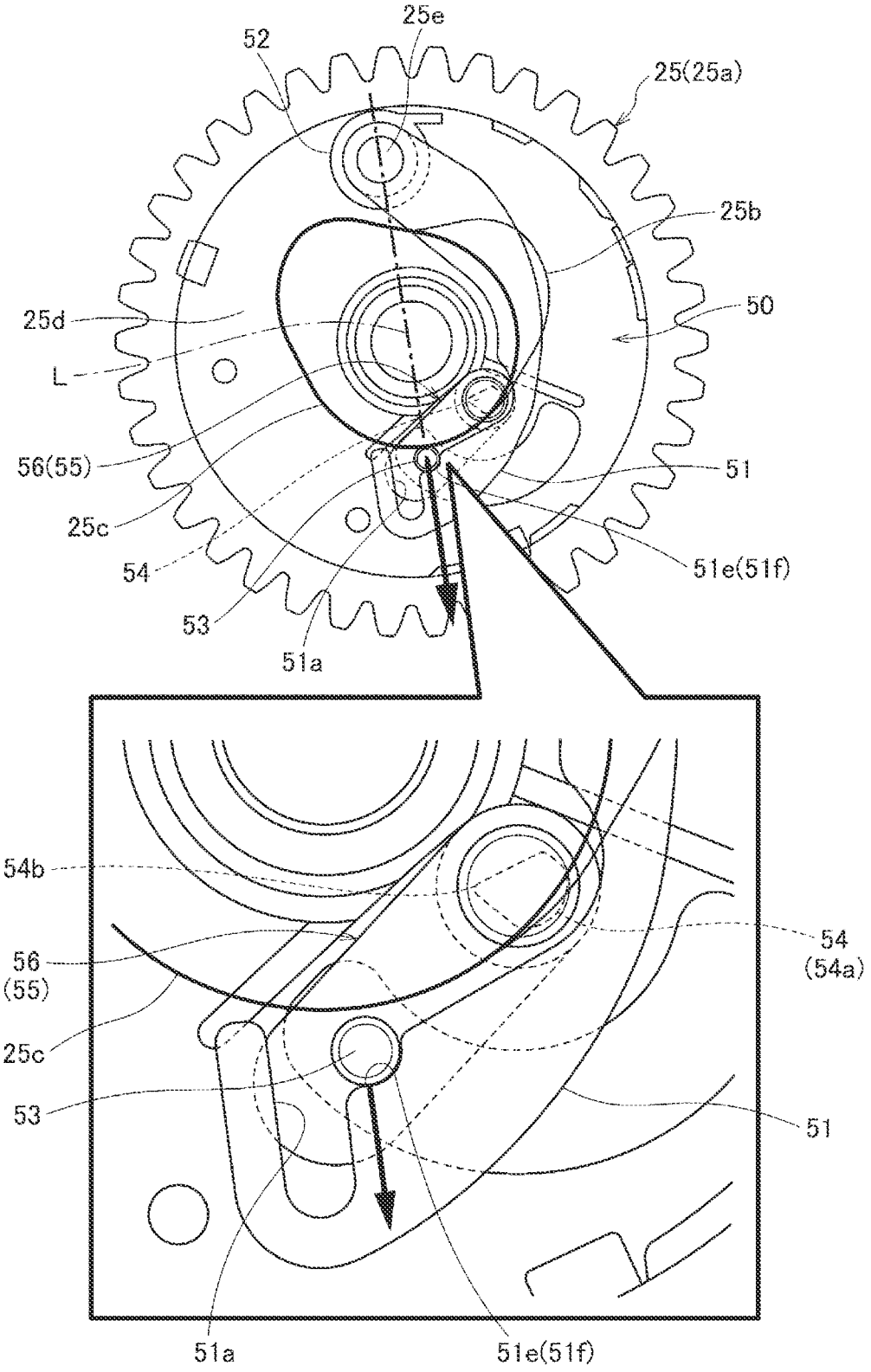
FIG. 10D is an explanatory view showing the decompression device (the decompression operation state) when the engine is reversely rotated.
Figure 11:
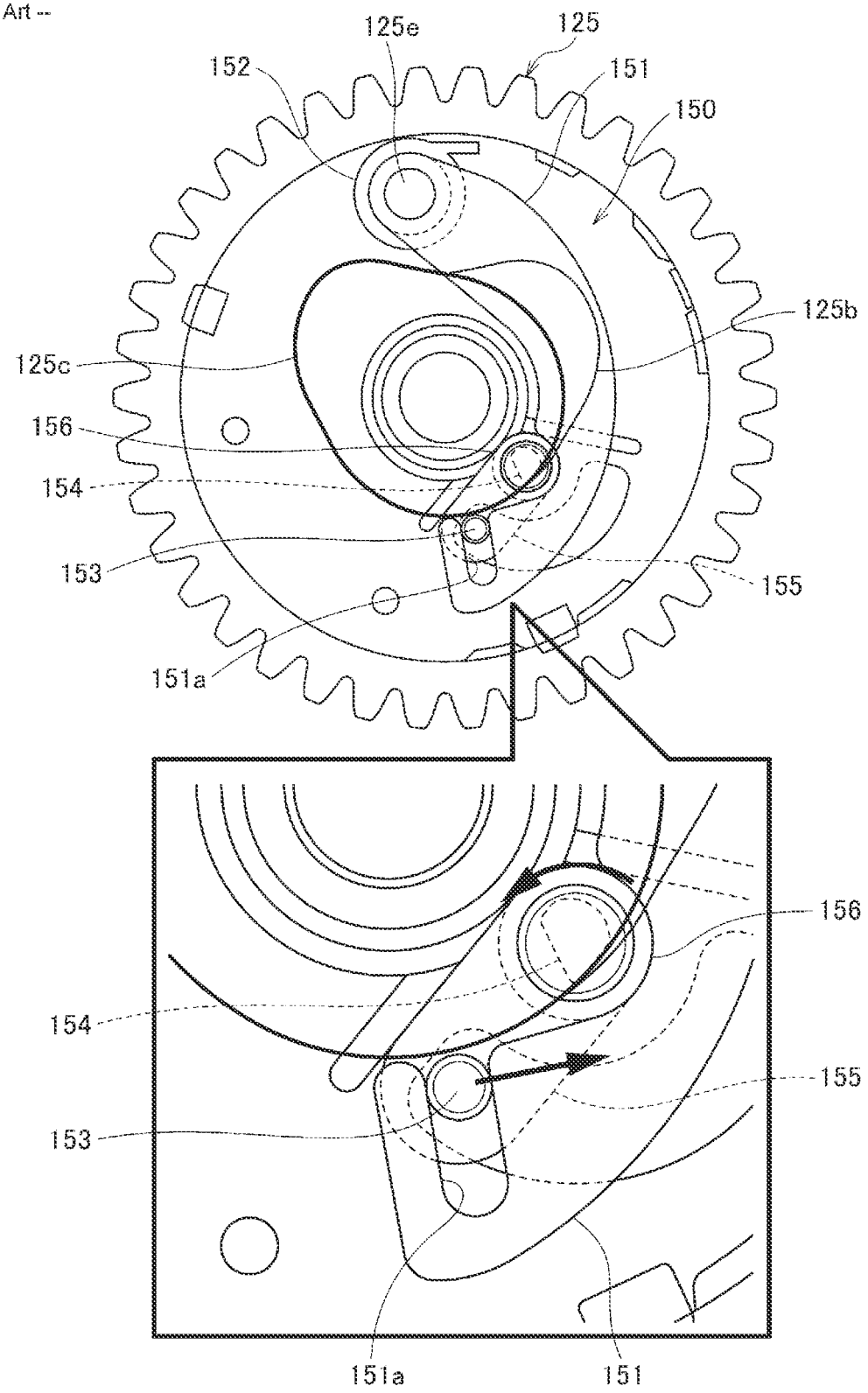
FIG. 11 is an explanatory view showing a decompression device in the related art.
Figure 12:
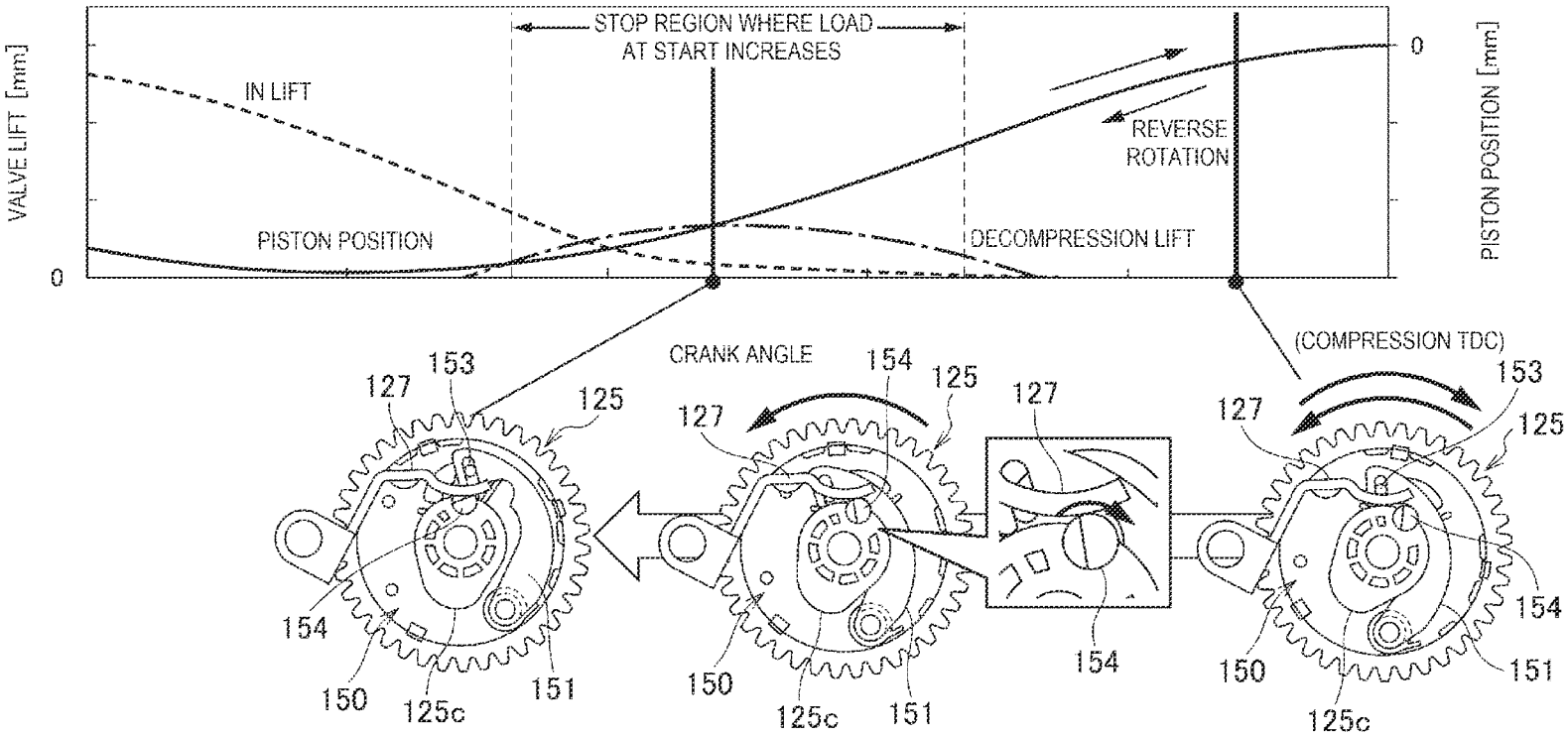
FIG. 12 is an explanatory view showing a movement of the decompression device in the related art when the engine is reversely rotated.

As shown in FIG. 10B, immediately after the engine E has been started, the decompression weight 51 rotates toward the decompression release position against a biasing force of the decompression spring 52 due to a centrifugal force. At this time, the engagement pin 53 of the decompression shaft 56 is located in the guide groove 51*a* of the decompression weight 51 and is pushed by the decompression weight 51 in a direction of an arrow in FIG. 10B, thereby rotating the decompression shaft 56 toward the decompression release position. As shown in FIG. 10C, after the engine E has been started, the decompression cam 54 provided on the decompression shall 56 is moved to the retracted position where the decompression cam 54 is retracted from the cam surface of the cam portion 25*b* or the cam portion 25*c*, thereby releasing the decompression lift of the intake valve 5 or the exhaust valve 6.

When the engine E is stopped, the decompression weight 51 rotates toward the decompression operation position due to a biasing force of the decompression spring 52. At this time, the engagement pin 53 of the decompression shaft 56 is located in the guide groove 51*a* of the decompression weight 51 and is pushed by the decompression weight 51 in a direction of an arrow in FIG. 10C, thereby rotating the decompression shaft 56 toward the decompression operation position. Therefore, after the engine E has been stopped, a state returns to the decompression operation state shown in FIG. 10A, and next startability of the engine E is improved.

When the engine E is stopped, the piston 4 may not overcome a compression top dead center, and reverse rotation may occur. When the engine E is reversely rotated at a time of stopping, a force in the direction in which the decompression cam 54 is moved from the advanced position to the retracted position acts on the decompression cam 54 from the lifter 27. This force attempts to rotate the decompression shaft 56 in the decompression release direction. However, when the engagement pin 53 of the decompression shaft 56 moves from a position in FIG. 10C to a position in FIG. 10D, the engagement pin 53 of the decompression shaft 56 abuts against only the restricting surface 51*f* of the rotation restricting groove 51*e* of the decompression weight 51.

That is, as described above, the rotation restricting groove 51*e* includes the restricting surface 51*f* orthogonal to the virtual line L connecting the pivot 25*e* and the engagement pin 53 when the decompression cam 54 is in the advanced position in the decompression operating state. When a force in the direction in which the decompression cam 54 moves from the advanced position to the retracted position acts on the decompression cam 54 from the lifter 27, the engagement pin 53 abuts against the restricting surface 51*f*. Therefore, a force from the engagement pin 53 to the decompression weight 51 acts only in a direction of an arrow in FIG. 10D. Therefore, a vector for rotating the decompression weight 51 does not act on the decompression weight 51, and the rotation of the decompression shaft 36 is restricted. Therefore, decompression release due to reverse rotation of the engine E when the engine E is stopped is prevented.

The above-described embodiment can be appropriately modified, improved, or the like. For example, in the above-described embodiment, a decompression device of a small-sized general-purpose engine provided in a walk-behind lawn mower or the like is shown. However, the decompression device according to the present invention is not limited to being applied to the small-sized general-purpose engine, and can be applied to various engines.

The present specification describes at least the following matters. Corresponding components in the above-described embodiment are shown in parentheses. However, the present invention is not limited thereto.

(1) An engine decompression device (the decompression device 50 of the engine E) including:

a camshaft (the camshaft 25) including an intake valve cam (the cam portion 25*c*) and an exhaust valve cam (the cam portion 25*b*);

a decompression weight (the decompression weight 51) that is rotatably provided via a pivot (the pivot 25*e*) provided on the camshaft;

a decompression spring (the decompression spring 52) configured to bias the decompression weight; and a decompression shaft (the decompression shaft 56) including an engagement pin (the engagement pin 53) that is guided by a guide groove (the guide groove 51*a*) formed in the decompression weight, a decompression cam (the decompression cam 54) that is provided on one cam surface of the intake valve cam and the exhaust valve cam so as to advance and retreat, and a connection portion (the connection portion 55) that connects the engagement pin and the decompression cam, in which, when the decompression weight rotates against a biasing force of the decompression spring due to a centrifugal force, the decompression shaft rotates such that the decompression cam moves from an advanced position where the decompression cam protrudes from the cam surface to a retracted position where the decompression cam is retracted from the cam surface, and in which the decompression weight is formed with a rotation restricting groove (the rotation restricting groove 51*e*) that restricts rotation of the decompression shaft when a force acts in a direction in which the decompression cam moves on the decompression shaft from the advanced position to the retracted position when the engine is stopped and that is continuous with the guide groove.

According to (1), when a force acts in a direction in which the decompression cam moves on the decompression shaft from the advanced position to the retracted position, the rotation of the decompression shaft is restricted by the rotation restricting groove formed in the decompression weight continuously with the guide groove, so that it is possible to prevent decompression release due to reverse rotation of the engine when the engine is stopped.

(2) The engine decompression device according to (1), in which the rotation restricting groove includes a restricting surface (the restricting surface 51*f*) orthogonal to a virtual line (the virtual line L) connecting the pivot and the engagement pin when the decompression cam is in the advanced position, and in which, when a force acts in a direction in which the decompression cam moves on the decompression shaft from the advanced position to the retracted position, the engagement pin abuts against the restricting surface.

According to (2), when a force acts in a direction in which the decompression cam moves on the decompression shaft from the advanced position to the retracted position, the engagement pin abuts against the restricting surface, so that a vector for rotating the decompression weight does not act on the decompression weight, and rotation of the decompression shaft is restricted.

(3) An engine (the engine E) including:

a valve mechanism (the valve mechanism 9) configured to operate an intake valve (the intake valve 5) and an exhaust valve (the exhaust valve 6) in accordance with rotation of a crankshaft (the crankshaft 2); and the decompression device according to (1) or (2), in which the valve mechanism includes:

a timing gear (the timing gear 24) to be fixed to the crankshaft;

the camshaft that rotates in conjunction with rotation of the timing gear;

a pair of lifters (the lifters 27) that abut against the intake valve cam and the exhaust valve cam;

a pair of rocker arms (the rocker arms 29) in which one end portions of the pair of rocker arms abut against the intake valve or the exhaust valve;

a pair of push rods (the push rods 30) configured to connect the pair of lifters to the other end portions of the pair of rocker arms; and a pair of valve springs (the valve springs 31) each configured to bias a respective one of the intake valve and the exhaust valve in a closing direction.

According to (3), when a force acts in a direction in which the decompression cam moves on the decompression shaft from the advanced position to the retracted position by the lifters when the engine is stopped, rotation of the decompression shaft is restricted by the rotation restricting groove. Accordingly, it is possible to prevent decompression release due to reverse rotation of the engine when the engine is stopped.

DESCRIPTION OF REFERENCE NUMERALS AND CHARACTERS

E engine
2 crankshaft
5 intake valve
6 exhaust valve
9 valve mechanism
24 timing gear
25 camshaft
25*b* cam portion (intake valve cam)
25*c* cam portion (exhaust valve cam)
25*e* pivot
27 lifter
29 rocker arm
30 push rod
31 valve spring
50 decompression device
51 decompression weight
51*a* guide groove
51*e* rotation restricting groove
51*f* restricting surface
52 decompression spring
53 engagement pin
54 decompression cam
55 connection portion
56 decompression shaft
L virtual line

The invention claimed is:

1. A decompression device for an engine, the decompression device comprising:

a camshaft including an intake valve cam and an exhaust valve cam;

a decompression weight rotatably provided on the camshaft via a pivot;

a decompression spring configured to bias the decompression weight; and a decompression shaft including an engagement pin guided by a guide groove formed in the decompression weight, a decompression cam provided on a cam surface of the intake valve cam or the exhaust valve cam so as to alternately advance and retract, and a connection portion that connects the engagement pin to the decompression cam, wherein, when the decompression weight rotates against a biasing force of the decompression spring due to a centrifugal force, the decompression shaft rotates such that the decompression cam moves from an advanced position where the decompression cam protrudes from the cam surface to a retracted position where the decompression cam is retracted from the cam surface, wherein the decompression weight is further formed with a rotation restricting groove continuous with the guide groove, the rotation restricting groove configured to restrict a reverse rotation of the decompression shaft so as to prevent the decompression cam from moving to the retracted position due to a force acting on the decompression cam when the engine is stopped, and wherein the rotation restricting groove is provided at a connecting portion between the guide groove and an inner peripheral portion of the decompression weight.

2. The decompression device according to claim 1, wherein the rotation restricting groove includes a restricting surface orthogonal to a virtual line connecting the pivot and the engagement pin when the decompression cam is in the advanced position such that the engagement pin abuts the restricting surface when the engine is stopped.

3. An engine comprising:

a valve mechanism configured to operate an intake valve and an exhaust valve in accordance with rotation of a crankshaft, the valve mechanism including:

a timing gear fixed to the crankshaft;

a camshaft that rotates in conjunction with rotation of the timing gear;

a first lifter abutting an intake valve cam of the camshaft;

second lifter abutting an exhaust valve cam of the camshaft;

a first rocker arm including a first end portion abutting the intake valve, and a second end portion connected to the first lifter via a first push rod;

a second rocker arm including a first end portion abutting the exhaust valve, and a second end portion connected to the second lifter via a second push rod; and a pair of valve springs each configured to respectively bias the intake valve and the exhaust valve in a closing direction; and a decompression device including:

a decompression weight rotatably provided on the camshaft via a pivot;

a decompression spring configured to bias the decompression weight; and a decompression shaft including an engagement pin that is guided by a guide groove formed in the decompression weight, a decompression cam provided on a cam surface of the intake valve cam or the exhaust valve cam so as to alternately advance and retract, and a connection portion that connects the engagement pin to the decompression cam, wherein, when the decompression weight rotates against a biasing force of the decompression spring due to a centrifugal force, the decompression shaft rotates such that the decompression cam moves from an advanced position where the decompression cam protrudes from the cam surface to a retracted position where the decompression cam is retracted from the cam surface, wherein the decompression weight is further formed with a rotation restricting groove continuous with the guide groove, the rotation restricting groove configured to restrict a reverse rotation of the decompression shaft so as to prevent the decompression cam from moving to the retracted position due to a force acting on the decompression cam when the engine is stopped, and wherein the rotation restricting groove is provided at a connecting portion between the guide groove and an inner peripheral portion of the decompression weight.

* * * * *